United States Patent [19]

Loos

[11] Patent Number: 4,903,434

[45] Date of Patent: Feb. 27, 1990

[54] HINGE JOINT

[75] Inventor: Horst Loos, Freudenberg, Fed. Rep. of Germany

[73] Assignee: Siegenia-Frank KG, Siegen, Fed. Rep. of Germany

[21] Appl. No.: 114,423

[22] Filed: Oct. 28, 1987

[30] Foreign Application Priority Data

Oct. 31, 1986 [DE] Fed. Rep. of Germany ..... 3637077

[51] Int. Cl.[4] ..... E05D 15/52

[52] U.S. Cl. ..... 49/192

[58] Field of Search ..... 49/192, 382, 193; 16/265, 266

[56] References Cited

U.S. PATENT DOCUMENTS

| | | | |
|---|---|---|---|
| 4,602,457 | 7/1986 | Krensel | 49/192 |
| 4,739,583 | 4/1988 | Tonsmann | 49/192 |

FOREIGN PATENT DOCUMENTS

| | | | |
|---|---|---|---|
| 1231591 | 12/1966 | Fed. Rep. of Germany . | |
| 2443866 | 4/1976 | Fed. Rep. of Germany . | |
| 8530860 | 12/1985 | Fed. Rep. of Germany . | |
| 777999 | 7/1937 | United Kingdom | 49/192 |

*Primary Examiner*—Kenneth J. Dorner
*Assistant Examiner*—Gerald A. Anderson
*Attorney, Agent, or Firm*—Blodgett & Blodgett

[57] ABSTRACT

A hinge joint for windows, doors, or the like which can especially be provided on the swing out arm of a disengagement device for rotary/tilt wing. An angular intermediate piece 14 is swingably held in a bearing block adapted to be fixed at a blind frame. It is connected with a supporting arm 15 which is swingable by 180° around an articulated axis 19—19 through a pivot pin connection. The supporting arm engages the wing as a holding element and is fixable in position with respect to the angular intermediate piece 14 in two swiveling positions offset by 180°. The end of the supporting arm 15 facing the angular intermediate piece 14 exhibits a fork shape having two parallel fork legs 38 adapted to pass laterally along a bearing eye 28 on the intermediate piece 14 wich encompasses the articulated axis 19—19. A cam or ledge 29 projects radially from the bearing eye forming stop surfaces pointing away from each other against which the fork legs 38 can be braced in each of two rotary positions offset by 180°.

5 Claims, 3 Drawing Sheets

HINGE JOINT

BACKGROUND OF THE INVENTION

The invention relates to a hinge joint for windows, doors or the like, especially on the swing-out arm or a disengaging device for rotary/tilt wings, on which an angular intermediate piece, horizontally swingable around a pivot pin, is held in a bearing block. The block is fixed on a blind frame. The intermediate piece is connected with a supporting arm swingable 180° around an articulated axle directed at a right angle to the pivot pin. The supporting arm engages at the wing as holding element and is positionally fixable at the intermediate piece in two swiveling positions offset by 180°.

Hinge joints of this type are already known and disclosed, for example, in DE-AS No. 12 31 591 and DE-AS No. 24 43 8661.

These hinge joints are mainly provided for use on the swing-out arm of a disengaging device for rotary/tilt wings. They can be used on windows, doors or the like with rotary wing, tilt wing or folding wing when their supporting arm is directly mounted on the folding surface of the wing, for example, by means of screws.

The hinge joints of this class have the advantage that they can readily be of one and the same construction for right or left position, because the supporting arm associated with the wing can be rotated by 180° relative to the angular intermediate piece. The rotation is around the articulated axle oriented at a right angle to the pivot pin which passes through the bearing block mountable at the blind frame. Through this the joint can be adjusted to the desired stop position.

In the two diverse rotation positions the supporting arm or the like can thus be fixed relative to the intermediate piece against undesired rotation around the articulated axle. This may be accomplished with the aid of additional locking elements which are in each case shiftable between a disengaging and an engaging position. These are actuated by hand or by means of a tool (DE-AS No. 24 43 866).

But through the DE-GM No. 85 30 860 it is also already known to assign a register device to the articulated intermediate piece and the supporting arm which fixes the 180° staggered or turned positions of the supporting arm at the angular intermediate piece. A pivot forming the articulated axle of the supporting arm is provided with two diametrically opposite, plane register surfaces on its perimeter which are in touch contact with a plane, bendable spring plate held in an uptake of the angular intermediate piece. The change-over from right to left stop or reverse requires only a simple manipulation. Despite this the optionally set relative position of the angular intermediate piece and supporting arm is fixed.

A deficiency on all previously known hinge joints of this class consists in the fact that the respective positional fixing of the articulated intermediate piece and of the supporting arm requires additional functional elements. These not only have to be specially made but require also additional installation work and correspondingly increase the manufacturing expenditure for such hinge joints.

The invention has the primary object to provide a hinge joint of the initially specified class where the fixing of the relative swivel position of supporting arm and intermediate piece can be achieved without the use of additional parts.

SUMMARY OF THE INVENTION

According to the invention this task is achieved by the characterizing features that the end of the supporting arm facing toward the intermediate piece has the form of a fork with two parallel legs, that the fork legs laterally pass by a bearing eye of the intermediate piece which takes up the articulated axle, and that a cam, a ledge, or the like projects radially from the bearing eye. The cam displaying two mutually averted stop surfaces against which one of the fork legs is supportable in each of the 180° offset swivel positions.

The fixing of the position for the two swivel positions is thus accomplished through the joining of supporting arm and angular intermediate piece by means of a pivot, forming the articulated axle.

More specifically, a hinge joint is provided on which the supporting arm is offset transverse to its main plane against the articulated axle but proceeds parallel thereto. The intermediate piece has a thickness which corresponds to a multiple, preferably at least to a triple, of the thickness of the supporting arm. The cam, ledge, or the like lies upon the symmetrical plane of the intermediate piece which is parallel to the swivel plane. The two stop faces have a spacing from this symmetry plane that is coordinated relative to the offset position of the supporting arm to the articulated axle.

In each of the two possible relative swivel positions of the supporting arm to the articulated intermediate piece in this design the top of the supporting arm terminates with the top of the articulated intermediate piece. Abutting the bottom of the supporting arm a formed part and/or a lock lug carrying the pivot can be provided.

Fixing registers are preferably and benefically associated with the fork legs of the supporting arm at the bearing eye of the intermediate piece. These can be formed, for example, by a bead or cam radially projecting over the lateral area of the bearing eye, with which the inside of the fork legs interact on account of their inherent spring action. Register fixations at the perimeter surface of the bearing eye lying diametrically opposite to the cam or the ledge have proved very satisfactory.

Sometimes in such a hinge joint the supporting arm is connected in longitudinal direction of the articulated axle in a limitedly adjustable manner with the intermediate piece in order to permit a positional adjustment of the wing relative to the blind frame and parallel to its plane. In this case it is particularly important according to the invention that the fork legs of the supporting arm and the cam, the ledge, or the like of the intermediate piece have a degree of overlapping in longitudinal direction which is dimensioned larger than the intended maximal degree of adjustment.

Throughout the positional adjustment of the supporting arm relative to the angular intermediate piece the intended fixing of the swing angle is not impaired by this arrangement.

The supporting arm of the hinge joint may form the swing-out arm of a rotary/tilt disengagement device. When for the locking position as well as for the rotary opening of the wing in parallel position to it the locking elements can be fixed and actuable through a connecting rod fitting then another characteristic feature of the invention is apparent; that in each case the fork leg distant from the opening side of the wing is supportingly carried by the cam, ledge, or the like, of the immediate piece.

In consequence, the reaction forces automatically arising at the supporting arm through the interaction of the lock elements provided, on the one hand, on the supporting arm and, on the other hand, on the connecting rod fitting of the wing side are securely conducted from the fork leg abutting at the cam or ledge into the angular intermediate piece. Thereby the durably secure interaction of the locking elements is assured. On the other hand, however, an angular shifting of the supporting arm around the articulated axle is allowed on the tilt motion of the wing around its lower, horizontal axis so that the bracing otherwise appearing on tilt wing disengagement devices as a result of the tilt opening is avoided.

BRIEF DESCRIPTION OF THE DRAWINGS

With the aid of the drawings the subject matter of the invention is hereunder explained in detail.

DETAILED DESCRIPTION OF THE PREFERRED EMBODIMENT

Figure 5:
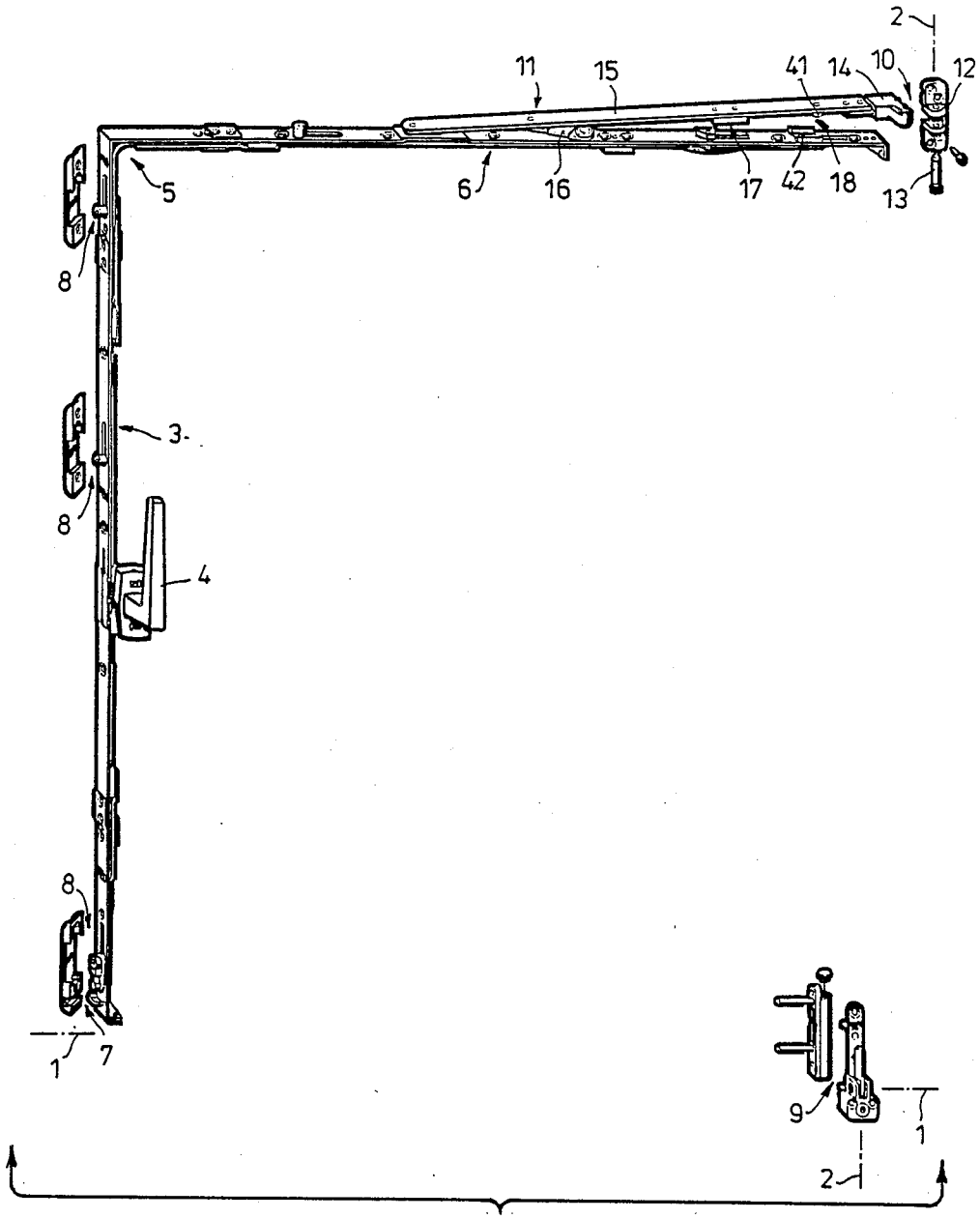
FIG. 5 is a spatial presentation of a preferred embodiment of a rotary tilt fitting for windows, doors or the like with a hinge joint according to the FIGS. 1 to 4.

In FIG. 5 of the drawing a rotary/tilt fitting is shown with the aid of which the wing of a window, a door or the like can be locked at the stationary frame in the locking position. It is so designed that through its actuation the wing can be opened against the stationary frame either about a lower horizontal axis 1—1 in tilt position or around a lateral upright axis 2—2 in rotary position.

The rotary/tilt fitting has for this purpose a component gear part 3 at the locking side which can be actuated through a service handle 4. On the top the gear component part 3 is followed by a corner return 5 with which, in return, a horizontal connecting rod part 6 is coupled.

A tilt lock 7 is assigned to the lower end of the gear component 3 between the wing and the stationary frame. In addition to this in the region of the component part 3 between the wing and the stationary frame there are several, e.g. three, locking devices 8, of which the lower one is combined as structural part with the tilt lock 7.

At the point of intersection of tilt axis 1—1 and rotation axis 2—2 the wing is braced at the stationary frame through a rotary/tilt corner bearing 9. The upper connection of the wing at the stationary frame consists of a hinge joint 10 which engages through a disengaging device 11 to the U-rail of the upper horizontal connecting rod part 6. The disengaging device 11 holds the wing in its closure position as well as in the tilt open position and in the rotary opening position in a functionally reliable manner at the blind frame.

Figure 1:
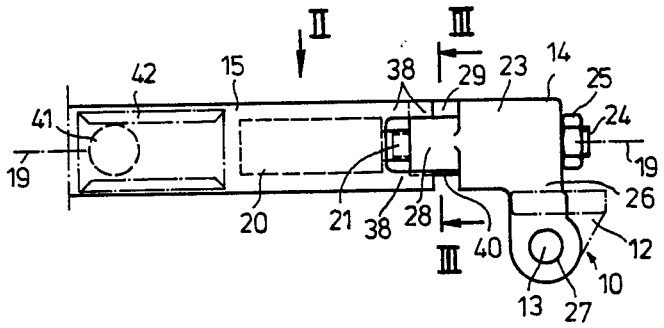
FIG. 1 shows, in top view, the essential area of a hinge joint.
Figure 2:
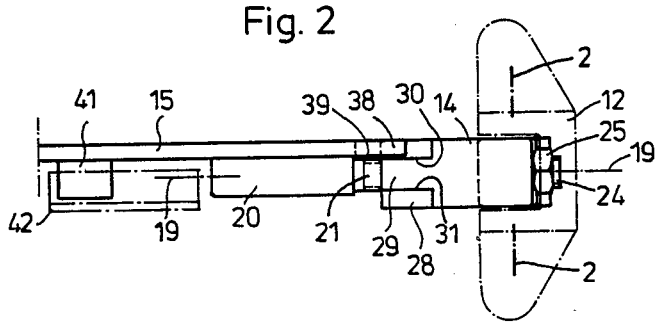
FIG. 2 illustrates the hinge joint according to FIG. 1 in back elevation according to the direction arrow II.
Figure 4:
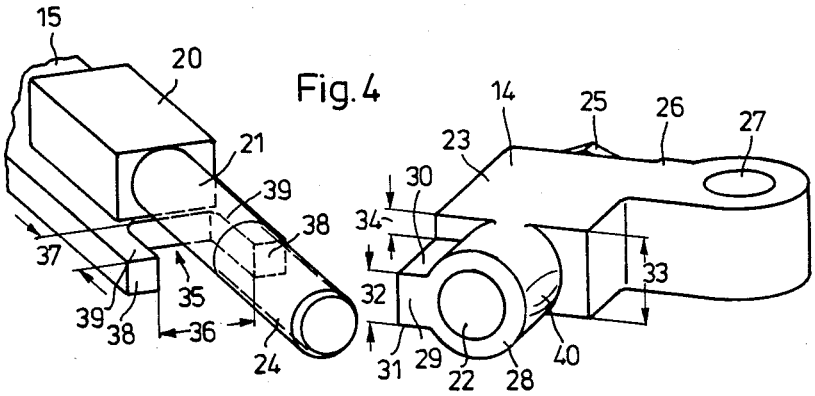
FIG. 4 is a spatially exploded view and on a larger scale shows the functionally essential parts of the hinge joint shown the FIGS. 1 to 3.
Figure 3:
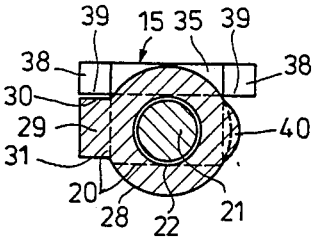
FIG. 3 shows a cut along the line III in FIG. 1 on a larger scale.

All functional parts of the rotary/tilt fitting shown in FIG. 5 are so executed that they can be installed both with the wing stopped at the right—as shown in FIG. 3 and also with the wing stopped at left—in mirror-inverted arrangement to FIG. 5. Fabrication and storage of the rotary/tilt fitting are thereby considerably simplified.

The hinge joint 10 of the rotary/tilt fitting includes a bearing block 12 that is to be attached at the stationary frame or blind frame. An annular intermediate piece 14 can be pivotally mounted thereon in aligned arrangement with the axis of rotation 2—2 around a pivot pin 13. The angular piece 14 in turn is in connection with a supporting arm 15 which forms according to FIG. 5 the swing-out arm of the disengaging device 11. In customary manner the device also has an additional arm 16 which engages, on the one hand, at the supporting arm 15 or at the swing-out arm and, on the other hand, at the wing or at the U-rail of the connecting rod component part 6 in a mobile and swivelling manner.

The disengagement device 11 is thus functionally arranged in the manner of a so-called trammel (ellipse guide).

Locking elements 17 and 18 make it possible to couple the swing-out arm or supporting arm 15 in lock position with the wing locked on the stationary frame and also, in swing-out position, parallel to the movable wing with the U-rail of the upper connecting rod component part 6. On the other hand it is possible to release the swing-out arm or supporting arm 15 by disengagement of the lock elements 17 and 18 so that the disengagement device 11 permits the tilt motion of the wing around the lower horizontal tilt axis 1—1 against the stationary frame and thereby limits the end-tilt position of the wing.

From the FIGS. 1 to 4 of the drawing it can be seen in this hinge joint 10 the angular intermediate piece 14 and the swing-out or supporting arm 15 are in pivotal connection with one another around an articulated axle 19—19 which is oriented at right angle to the pivot pin 13 of the bearing block 12 over an angular range of 180°. For this purpose a plate 20 is mounted at a broadside, that is, the underside of the supporting arm 15 on which rests a pinion or pivot 21 projecting beyond the free end of the supporting arm 15. This pinion 21 has a circular cross section and is guided through a channel 22 adapted to this cross section. The pinion extends over the whole length through the first leg 23 of the angular intermediate piece 14. The pinion 21 is provided at least on a part of its length with a thread 24 through which it interacts with a nut 25. The nut is pivotally but axially immovably supported near to the corner zone between the first leg 23 and the second leg 26 of the angular intermediate piece 14. The second leg 26 of the angular intermediate piece 14 is provided with a through-hole 27 which extends at a right angle to the channel 22 and which forms a bearing opening through which the pivot pin 13 of the frame-sided bearing block 12 can be pushed.

Onto the end on the angular second leg 26 of the angular intermediate piece 14 lying opposite to the nut 25 and facing towards the supporting arm 15 a bearing eye 28 is molded in one piece which extends coaxially to the passage 22 or the articulated axle 19—19.

From this bearing eye 28 a cam or a ledge 29 or the like projects radially in a direction lying parallel to the swivel plane of the angular intermediate piece 14 and to the longitudinally limiting face of the leg 23 averted from the leg 26.

The cam or the ledge 29 has two mutually averted first and second stop surfaces 30 and 31 which lie symmetrically to the symmetry plane of the angular intermediate piece 14 and pass through the articulated axle 19—19. They thus have coincident spacing therefrom.

The thickness of the cam or of the ledge 29 (that is, the distance between the two stop surfaces 30 and 31) corresponds to only a fraction, e.g. one third, of the total thickness of the angular intermediate piece 14 or of its leg 23.

A step, the height 34 of which is adjusted to the thickness of the supporting arm, is provided following each of the stop surfaces 30 and 31 of the cam or the ledge 29 in the region of the bearing eye 28 at the leg 23 of the angular intermediate piece 14.

The end of the supporting arm 15 facing the leg 23 of the angular intermediate piece 14 is provided with a cutout 35 the width 36 of which is adjusted to the diameter of the bearing eye 28. The cutout has a depth 37 which is at least equal to the length of the bearing eye 28.

As a consequence of the cutout 35 two parallel fork legs 38 are formed at the rear end of the supporting arm 15. In this way the end of the supporting arm 15 facing the angular intermediate piece 14 exhibits the shape of a fork The supporting arm 15 is coupled with the angular intermediate piece 14 by means of the pinion 21 aligned with the articulated axle 19—19 and the nut 25. The two fork legs 38 pass laterally by the bearing eye 28 which takes up the pinion 21 in the passage 22. In each case one of the two fork legs 38 can thus engage, through the stop face 39 formed by its underside, in operative connection with one of the stop surfaces 30 and 31 at the cam or ledge 29 of the bearing eye 28. This limits the swivel position of the supporting arm 15 relative to the angular intermediate piece 14. In this manner it is possible to bring the supporting arm into two end positions relative to the angular intermediate piece 14 which are opposed to one another by 180° around the articulated axle 19—19. Thus, in each one of these end positions in a given direction a firm bracing is brought about between the supporting arm 15 and the intermediate piece 14.

By the interaction of the pinion 21 which is provided with the thread 24 with the nut 25, the supporting arm 15 can be continuously adjusted relative to the angular intermediate piece 14 in direction of the articulated axle 19—19. This permits a positional adjustment of the wing held by the supporting arm 15 relative to the stationary frame. However, over the whole longitudinal adjusting range the fork legs 38 of the supporting arm 15 remain within the longitudinal range of the bearing eye 28 at the leg 23 of the angular intermediate piece 14 so that its operative connection with the cam or ledge 29 and the stop surfaces remains assured.

Since the two fork legs 38 of the supporting arm 15 display a certain inherent laterally directed springiness, it is possible to fix the two swing positions of the supporting arm 15 (which are offset by 180° towards one another relative to the angular intermediate piece 14 or its leg 23) in position. For this is merely necessary to form out a fixing notch 40 on the bearing eye 28, and this, preferably at the circumferential point lying diametrically opposite one of the cams or the ledge 29. For example, this may be formed in the shape of a bead, with which engages, in each case in operative connection, one of the fork legs 38 of the supporting arm 15 by means of the forks inner, underside longitudinal ledge in the manner of a snap-latch.

The fixing notch 40 can simply be fabricated so that it fixes the supporting arm 15 in its factory-preassembled setting relative to the angular intermediate piece 14. Before the installation of the hinge-joint an optional, one-time angular displacement of the supporting arm 15 by 180° around the angular intermediate piece 14 is thus permitted.

After the functionally correct installation of the hinge joint 10 the fixing notch 40 is no longer needed in practice. On the one hand, the angular intermediate piece 14 is aligned through the frame-side bearing block 12 relative to the stationary frame. On the other hand, the supporting arm 15 stands in holding connection with the wing.

The supporting arm 15 of the hinge joint 10 may form, as is the case according to FIG. 5 of the drawing, the swing-out arm of a rotary/tilt disengagement device 11. It then acts, as already pointed out above, through locking elements 17 and 18 with the connecting rod fitting mounted at the wing. For tilt opening, however, the supporting arm 15 forming the swing-out arm of the disengagement device 11 must be disconnected from the U-rail of the connecting rod component 6 so that it can execute the angular displacement necessary thereto and so that the disengagement device 11 can be spread and folded in the manner of a trammel (ellipse guide).

In the engagement position of the locking elements 17 and 18, that is, in the closure position and for the rotary opening of the wing, the upper lock ears 41 each located at the underside of the supporting arm 15, are undercut by the lower lock ears 42 which are adjustable by means of the connecting rod part 6. Because of this a torsional moment acts around the articulated axle 19—19 upon the supporting arm 15. This moment attempts to twist the supporting arm relative to the angular intermediate piece 14. This torsional moment is intercepted in each case by the fork leg 38 of the supporting arm 15 abutting with its supporting surface 39 on the stop surface 30 or 31 of the cam or ledge 29 at the angular intermediate piece 14. This prevents an undesired uncoupling of the lock ears 41 and 42.

On tilt opening of the wings the supporting arm 15 forming the swing-out arm of the disengagement device 11 can be limitedly twisted around the articulated axle 19—19 relative to the angular intermediate piece 14 so that the whole rotary/tilt disengagement device 11 may be relieved from the torsional forces normally acting on it.

When hinge joints 10 are to be used for windows and doors with rotary wings or for windows with tilting or folding wings then the supporting arm 15 forms a mounting rail which is directly attached at the fold face of the wing and is oriented parallel to its plane. In this case it may be advisable to design the supporting arm 15 as an L-strap which then embraces the corner area of the wing and can be mounted on two of the wings fold faces which lie at right angles to one another.

It is also possible to provide the pinion 21 of the plate 20 at its circumference with two diametrically opposite surfaces adapted to interact with secantial ribs projecting into the cross section of the channel 22 at the free end of the bearing eye 28 as torsion insurance. The ribs however may be so dimensioned that they can be sheared off or destroyed when subjected to a sufficiently great torsional force effect upon the pinion 21 through the action of the longitudinal edges which limit the plane surfaces. Such surfaces of the pinion 21 and ribs in the channel 22 of the bearing eye 28 are ordinarily to interact as safety elements during assembly and storage and are not functionally necessary after installation of the hinge joint.

I claim:

1. A hinge joint for a window or door closure or the like comprising:

(a) a swing out arm incorporated in a disengaging device the arm having an end in the shape of a fork with two legs encompassing a cutout, the arm carrying a plate having a pivot pin extending therefrom, (b) a bearing block adapted to be attached to a stationary frame, the block encompassing a pivot bearing receiving a vertical pivot pin, and (c) an angular intermediate piece between the arm and the block having a first and a second leg, the first leg provided with a bearing eye containing a channel adapted to receive the pinion and about which the piece is rotatable, the legs of the fork pass by the bearing eye on either side so that the eye is contained in the cutout, the bearing eye provided with a cam extending radially therefrom having first and second opposed stop surfaces, each stop surface contacting surfaces of the legs of the fork to lock the arm in either one of two swivel positions of the arm relative to the intermediate piece, which positions are 180° apart, the second leg of the intermediate piece containing a through hole directed at a right angle to the channel and attachable to the bearing block, pivot bearing a pivot pin.

2. A hinge joint as recited in claim 1, in which swing out is in an offset position transverse to the plane of the surfaces of the legs relative to the axis of the pivot pin and parallel thereto and the intermediate piece has a thickness corresponding to a multiple of the thickness of the supporting arm, and wherein the cam lies symmetrical to the axis of the axis of the bearing eye on the intermediate piece, the two stop surfaces having a spacing from the symmetrical plane related to the offset position of the supporting arm to the axis.

3. A hinge joint as recited in claim 1, wherein a fixing notch is provided on the bearing eye of the intermediate piece located to positively engage one of the fork legs of the supporting arm.

4. A hinge joint as recited in claim 1, in which the swing out arm has a limited movement in the longitudinal direction along the axis and the fork legs of the supporting arm overlap with the cam by a distance greater than the said limited movement.

5. A hinge joint as recited in claim 1, wherein the swing out arm operates in a rotary/tilt disengaging device, wherein the disengaging device has locking elements which are actuated by a connecting rod fitting and are locatable to define a closure position as well as a rotary opening of the wing into a parallel position, and wherein that fork leg which is located away from the opening side of the closure contacts the cam of the intermediate piece.

* * * * *